US005905475A

United States Patent [19]

Annamaa

[11] Patent Number: 5,905,475

[45] **Date of Patent: *May 18, 1999**

[54] ANTENNA, PARTICULARLY A MOBILE PHONE ANTENNA, AND A METHOD TO MANUFACTURE THE ANTENNA

[75] Inventor: Petteri Annamaa, Oulu, Finland

[73] Assignee: LK Products Oy, Kempele, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/628,828

[22] Filed: Apr. 5, 1995

[30] Foreign Application Priority Data

Apr. 5, 1995 [FI] Finland ..... 951628

[51] Int. Cl.[6] ..... H01Q 1/36

[52] U.S. Cl. ..... 343/895; 343/702; 29/600

[58] Field of Search ..... 343/702, 872, 343/873, 895, 906; 29/600

[56] References Cited

U.S. PATENT DOCUMENTS

| | | | |
|---|---|---|---|
| 2,938,210 | 5/1960 | Harris | 343/895 |
| 4,611,213 | 9/1986 | Johnson et al. | 343/702 |
| 4,725,395 | 2/1988 | Gasparaitis et al. | 343/895 |
| 5,262,792 | 11/1993 | Egashira | 343/702 |
| 5,341,149 | 8/1994 | Valimaa et al. | 343/895 |
| 5,343,213 | 8/1994 | Kottke et al. | 343/702 |
| 5,436,633 | 7/1995 | Liu | 343/723 |
| 5,742,259 | 4/1998 | Anamaa | 343/895 |

FOREIGN PATENT DOCUMENTS

| | | | |
|---|---|---|---|
| 911435 | 9/1992 | Finland | H01Q 1/40 |
| 9217006 | 7/1993 | Germany | H01Q 1/22 |
| 2202380 | 9/1988 | United Kingdom | H01Q 11/08 |
| 2286927 | 8/1995 | United Kingdom | H01Q 1/40 |

*Primary Examiner*—Hoanganh T. Le
*Assistant Examiner*—Tan Ho
*Attorney, Agent, or Firm*—Darby & Darby

[57] ABSTRACT

A helical mobile phone antenna with a support part (7), a connector (9) connected to the helix, and a protecting case (6) surrounding the helix and the support part. The support part and the connector part are integrally formed, whereby a weak joint between them is eliminated. The lower end of the connector may have an electrically conducting sleeve (5) and is preferably threaded so the antenna can be mounted. The support part (7) and the connector part (9) are molded into an integral body (5), preferably so that the support part surrounds the threaded part of the helix (2), and that the connector part (4) surrounds with a clearance the leg part (3) of the helix. An electrically conducting cylindrical sleeve (5) is connected to the lower end of the connector part, preferably so that the sleeve is arranged in the injection mold, and is fastened to the connector part during molding. Connecting threads (10) for the antenna are formed in the peripheral surface of the connector part or the sleeve.

25 Claims, 4 Drawing Sheets

FIG. 2
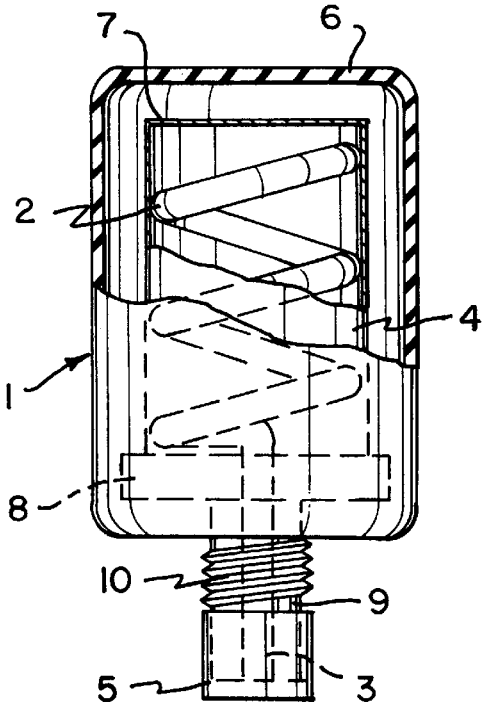
FIG. 3
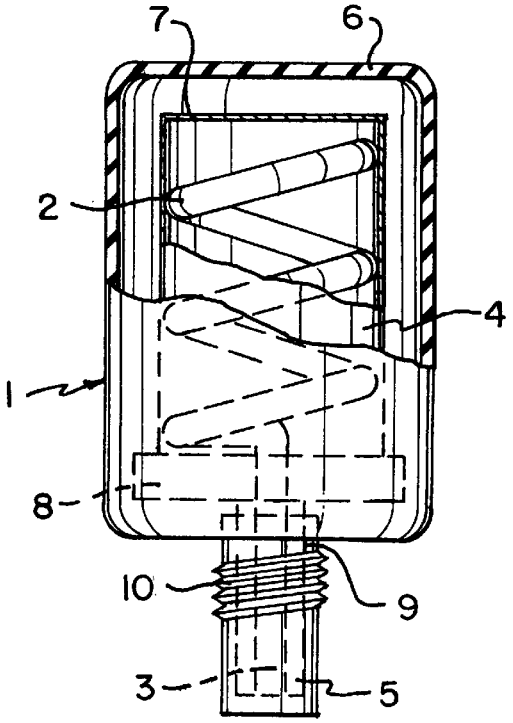
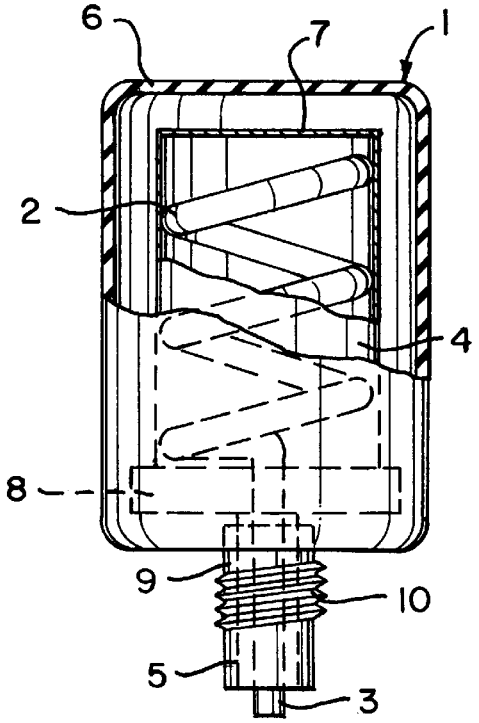
FIG. 4

FIG. 5a
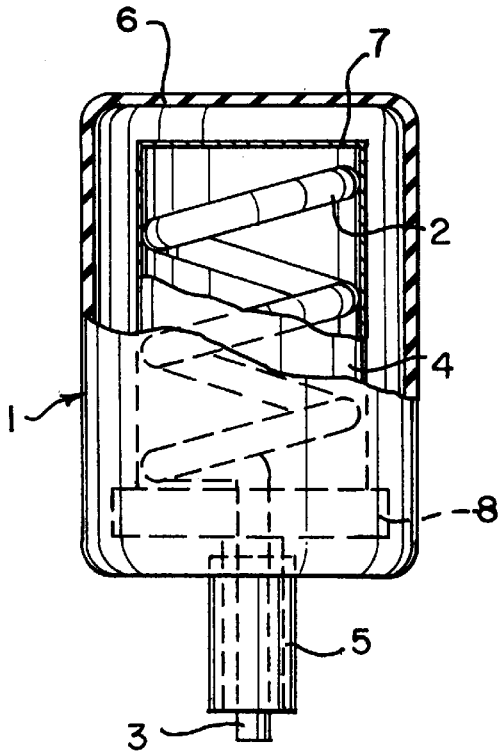
FIG. 5b
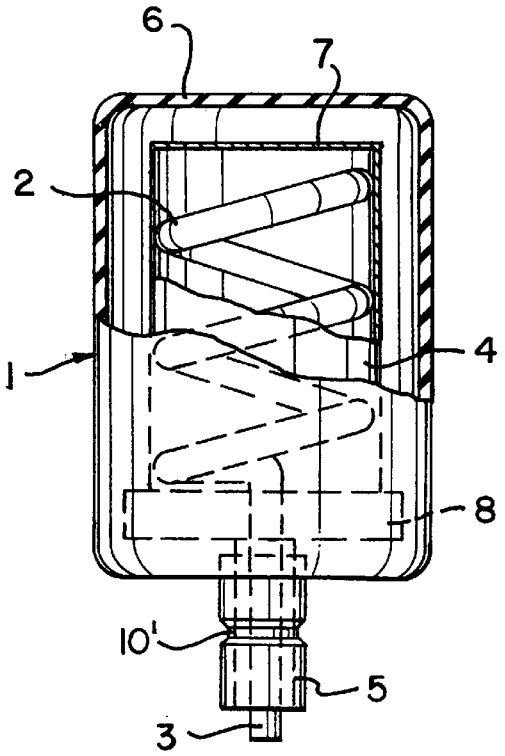
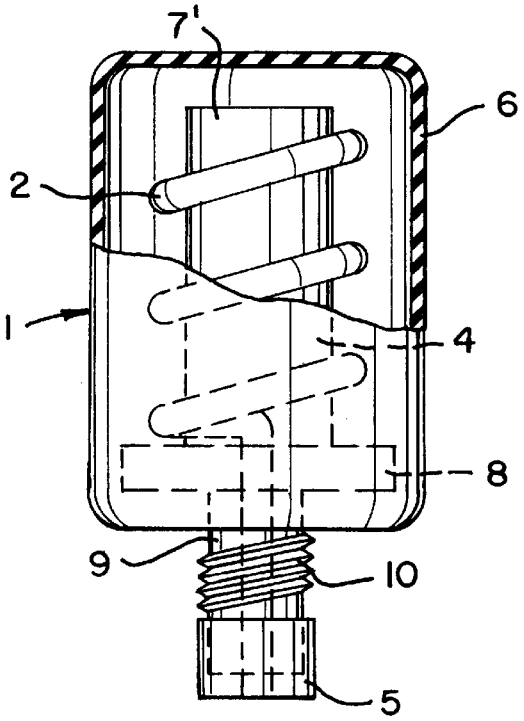
FIG. 6

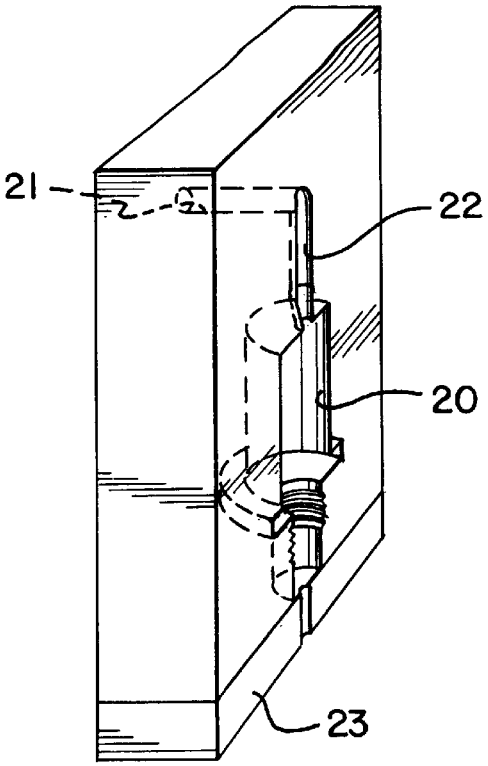
FIG. 7a
FIG. 7b
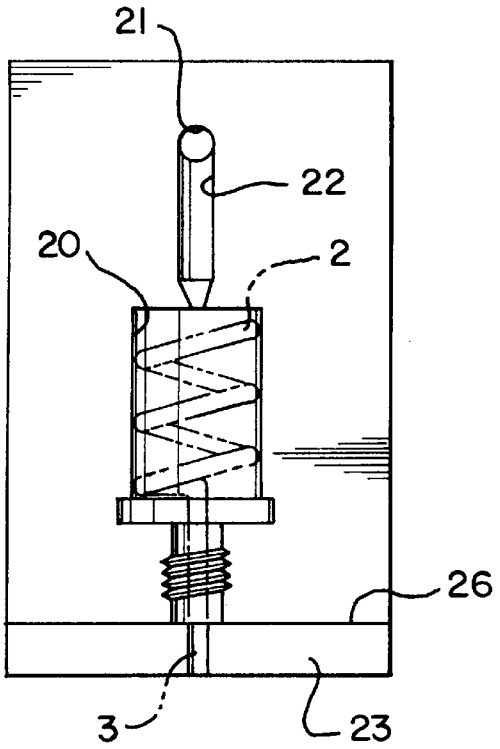
FIG. 7c
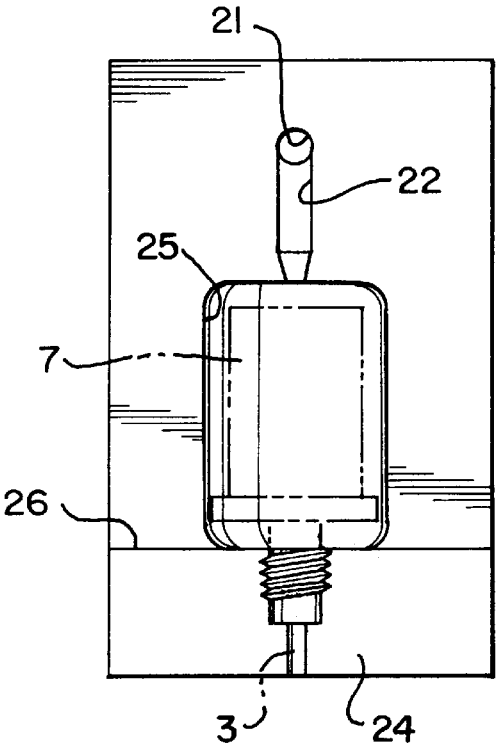

ANTENNA, PARTICULARLY A MOBILE PHONE ANTENNA, AND A METHOD TO MANUFACTURE THE ANTENNA

FIELD OF THE INVENTION

The object of the invention is an antenna, particularly a mobile phone antenna, and a method to manufacture the antenna, as specified in the introductions of claims 1 and 10.

BACKGROUND OF THE INVENTION

The antenna which is the object of the invention is a helix antenna, or a spiral antenna. In the following we call it a "helix antenna", which is the term generally used in the art. The helix antenna is a well known antenna structure. The helix antenna comprises a helix which has a short central leg part, and a connector which is connected to the helix leg, e.g. by soldering. The connection between the helix and the connector is approximately in the center of the antenna structure. The structure is thus sensitive to bending, shocks and other mechanical stresses. The interior of the antenna can be supported by forming a support part within the helix. The known helix antenna is manufactured by separately injection molding its inner and outer parts, either in the same material or in different materials. The helix part is covered with an outer cover, which is made e.g. by injection molding, or with a rubber sheath which is glued on with the connection line in the upper part of the connector. The manufacture comprises several steps, and particularly sensitive steps are the soldering of the connector and helix, and the gluing of the rubber sheath.

SUMMARY OF THE INVENTION

The object of this invention is to provide an antenna structure and a method to manufacture it, in which both the antenna support body and the antenna connector part are made in substantially one step, and which method is simple, advantageous and fast, whereby the antenna manufactured according to the method is mechanically durable and applicable to mobile phones.

This is achieved with the antenna according to the invention and with the invented method, whose main characteristics are presented in the characterizing clauses of claims 1 and 10.

The antenna according to the invention comprises a helix having a central leg part which is bent downwards, a combined support and connector part of rigid and durable material, and an electrically conducting member connected to the helix leg in order to provide an electrical contact for the antenna. The antenna is covered with an elastic protective material.

The combined support and connector part is made of durable and sturdy material, advantageously plastics, preferably by simultaneous injection molding around the helix and the leg part. Thus both the helix support and the antenna connector are made in one step. Preferably the support and the connector form an integral body, the support and connector part.

Depending on the part the antenna connector will engage, a cylindrical sleeve is preferably mounted around the lower end of the support and connector part to provide the required electrical contact for the antenna. The sleeve can be mounted in the connector part after the injection molding, or in connection with the injection molding, whereby it is arranged in the mold before the injection.

The advantage of the method according to the invention is that both the antenna support and the antenna connector can be made in one step. Coaxial connecting parts having an inner conductor, insulator and outer sheath, as well as ordinary connector parts having a simple "hot wire" for the electrical connection, can be made in a simple way with the method. The method reduces the number of required components and operating steps.

The great advantage of the antenna according to the invention is that the delicate connection between the connector and the helix is eliminated, or moved to the lower part of the antenna structure, where it is not exposed to mechanical stress, bending or shocks.

The antenna according to the invention is not limited to any certain application, but it may be used in antennas for different applications and for different frequencies, preferably for radio frequencies, such as UHF and VHF. The antenna structure is preferably applied in mobile phone antennas.

BRIEF DESCRIPTION OF THE DRAWINGS

The antenna according to the invention and its manufacturing method is described in more detail below in the form of preferred embodiment examples with reference to the enclosed figures, in which:

FIG. 2 shows a vertical section of an antenna manufactured according to the method of FIG. 1*b;*

FIGS. 3, 4, 5*a,* 5*b* and 6 show vertical sections of modifications of the antenna of FIG. 2; and FIG. 7*a* is a front perspective view of the injection part of the mold used for forming the helix antenna; FIG. 7*b* is a front elevational view of the part shown in FIG. 7*a;* and FIG. 7*c* is a front elevational view of the injection part of the mold used for forming the protective case for the antenna.

Corresponding parts in the different figures are marked with the same numerals.

DESCRIPTION OF THE PREFERRED EMBODIMENTS

Figure 1A:
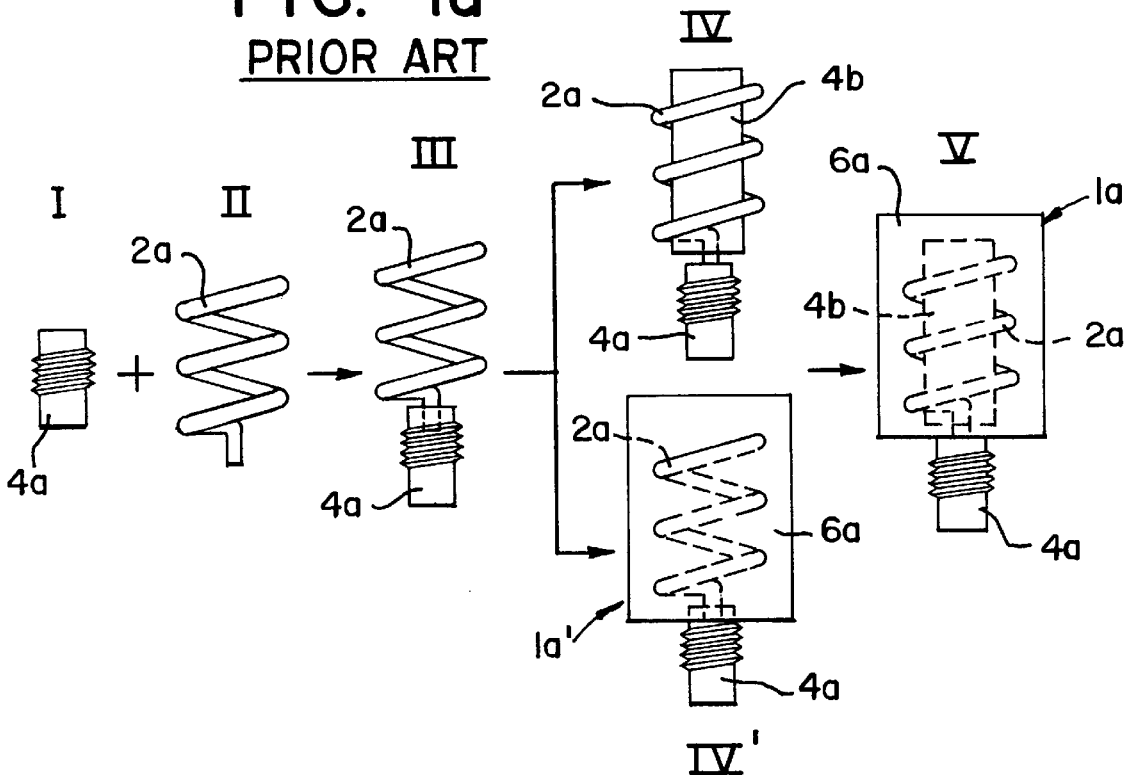
FIG. 1a PRIOR ART
FIG. 1*a* illustrates two alternative methods to manufacture a helix antenna (prior art)

FIG. 1*a* shows a traditional way to manufacture a helix antenna 1*a*. A connector 4*a,* step I, and a helix 2*a,* step II, are first made separated. Then in step III the connector and helix are connected, by e.g. soldering. The connection is substantially in the center of the antenna structure, or immediately adjacent to that point. Then in step IV the helix is supported with a support 4*b,* and the helix is covered with an outer case 6*a* in step V. Alternatively a separate rubber sheath can be glued on the structure after step III, so that the sheath is connected to the connector in the upper part thereof, step IV'. The manufacturing process comprises several operating steps, and of these the soldering of the connector 4*a* and the helix 2*a,* step III, and the gluing of the rubber sheath 6*a,* step IV', are particularly sensitive.

Figure 1B:
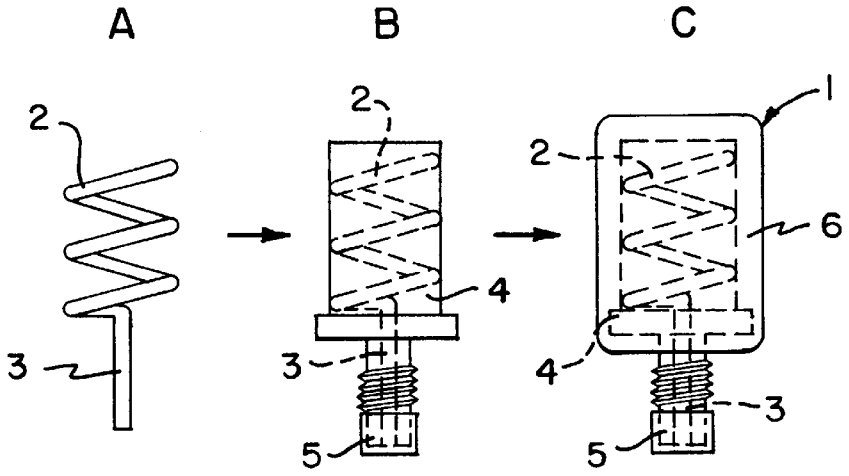
FIG. 1*b* illustrates a preferred method to manufacture a helix antenna according to the invention.

FIG. 1*b* shows the simplified way according to the invention to manufacture an antenna. We begin with a helix 2, which has a leg part 3 first bent into the center and then straight down, and which extends in the axial direction approximately for the same length as the helix part, step A. In step B a common support and connector structure 4 is molded around the helix and the leg part. A simple sleeve 5 is arranged in the lower end of the mold, whereby the sleeve will be connected to the lower end of the support and connector part during the molding. In step C the helix is covered with elastic material 6, which preferably is made by injection molding in the same way as step B.

In this way both the support for the antenna and the required connector part are made in one step by forming a common support and connector part 4, and the sensitive connection step, in which the helix and the connector are joined, is now eliminated. The antennas 1*a* and 1*a*' are of a lower quality than the antenna 1 according to the invention, because they have a delicate joint between the helix and the connector part, which is not present in the antenna according to the invention.

The helix antenna 1 shown in FIG. 2 corresponds to the finished antenna of FIG. 1*b*. The integral support and connector part 4 is molded around the helix. The upper support part of the combined support and connector part is marked by the numeral 7 and it covers the spiral part 2 of the helix. The support part 7 has a diameter which corresponds to the outer diameter of the spiral part, and it is slightly higher than the spiral part.

Between the support part 7 and the lower connector part marked by the numeral 9 there is a support ring 8 with a larger diameter and smaller height, which adds to the mechanical strength of the antenna. At the lower end of the lower connector part there is a sleeve 5, to which the helix leg part 3 is joined to provide an electrical contact for the antenna. The peripheral surface of the connector part 9 is provided with threads 10, with which the antenna is mounted in its place of use.

The antenna shown in FIG. 3 differs from the antenna of FIG. 2 only by the fact that any required thread part of the antenna is in the sleeve 5, and not in the connector part 9. Therefore the sleeve is a slightly longer cylindrical part, whose upper edge is covered by the protective case 6. The threaded part 10 is formed in the peripheral surface of the sleeve.

The antennas shown in FIGS. 2 and 3 have simple, so called "lot wire" connectors, in which the sleeve 5 and the helix leg part 3 have an electrical contact at the lower end of the antenna structure.

The antennas shown in FIGS. 4, 5 and 6 have coaxial connectors in which the helix leg part 3 forms the inner conductor of the connector, and the lower connector part 9, preferably of the same material as the helix support part 7, forms the dielectric medium, and a simple sleeve 5 forms the outer sheath of the connector. There is no electrical contact between the outer sheath and the inner conductor of the coaxial connector.

The antennas of FIGS. 4, 5*a* and 5*b* only differ regarding the connecting means. The sleeve 5 in the antenna according to FIG. 4 is provided with a threaded part 10, the antenna according to FIG. 5*a* has no particular connecting means, and the antenna according to FIG. 5*b* has a thin peripheral groove 10'.

The antenna shown in FIG. 6 has a "hot wire" connector. It differs from the antenna shown in FIG. 2 only in that the upper support part 7' is formed within the helix, so that the diameter of the support part corresponds to the inner diameter of the helix. The height of the support part is slightly larger than the height of the threaded part of the helix.

FIGS. 7*a*, 7*b*, and 7*c* show the injection molds, with which the antenna according to the invention can be manufactured. An injection mold space 20 is tooled into the halves of the mold, the space being at the same time the chamber for the helix 2, which is placed in the mold. The space 20 contains forms both for the support part 7 and the connector part 9 of the antenna, these forms being in the same chamber. The helix is fixed in the chamber below 23 the closing surface 26 by pressing the helix wire between the halves of the mold, or by using a separate core, not shown in the figures, to which the helix is fastened during the molding. The numerals 21 and 22 show the locations of the injection nozzle and of the injection channel.

The final appearance and design are provided by molding a layer of elastic protecting material over the above described helix support part. This requires a separate mold or a separate chamber, in which a space and form 25 is tooled for case 6 covering the antenna. In this step the closing surface 26 is higher up. The support part 7 molded in the first step is locked at the closing surface 26, whereby by-passes for the antenna connector have been made in the lower part 24 of the mold. Alternatively we could again use the core not shown, to which the part molded in the first step is locked during the molding.

Above we presented a preferred way to manufacture antennas according to the invention. However, for person skilled in the art it is obvious that the manufacture could be made in many other alternative ways.

I claim:

1. An antenna (1) comprising a helix (2), a one-piece upper support part and lower connector part, wherein said upper support part (7) supports the helix and said lower connector part (9) connects to the helix, and a protective material layer surrounding the helix and the support part, wherein the lower connector part (9) surrounds a helix leg part (3) which is bent towards the axis of the helix and extends in the direction of the axis through the connector part (9), the lower end of the support part including a support ring (8) with a diameter larger than the helix, and an electrically conducting means (5) connected to the connector part in order to provide an electrical contact for the antenna.

2. An antenna according to claim 1 wherein the support and connector part (4) comprise a coatable material, including hard, heat-resistant plastic, polymer material or ceramic material.

3. An antenna according to claim 1 or 2, wherein the electrically conducting means is a cylindrical sleeve (5).

4. An antenna according to claim 3, wherein the leg part (3) of the helix contacts the lower end of the sleeve, and the connector part forms a simple "hot wire" connector.

5. An antenna according to claim 3, wherein the connector part forms a coaxial connector in which the leg part (3) of the helix forms the inner conductor, the material of the support and connector part (4) is dielectric material, and the sleeve (5) forms the outer sheath.

6. An antenna according to claim 1, further comprising connecting means in the connector part (9) below the protecting layer (6) in order to connect the antenna.

7. An antenna according to claim 6, wherein said connecting means comprises threads.

8. An antenna according to claim 1, further comprising a sleeve surrounding at least a portion of the connector part, wherein connecting means are provided in the sleeve (5).

9. An antenna according to claim 8, wherein said connecting means comprises threads.

10. An antenna according to claim 1, wherein the support part (7) comprises a first cylindrical part, having a diameter corresponding to the outer diameter of the helix (2) and extending from the bottom edge of the helix at least to its top edge, whereby the first cylindrical part surrounds the helix, said support ring (8) being substantially cylindrical with a larger diameter and smaller height than said first cylindrical part, and the connector part (9) comprises a second cylindrical part with a smaller diameter than said first cylindrical part and surrounding the leg part (3) of the helix.

11. An antenna according to claim 1, wherein the support part (7) comprises a first cylindrical part, having a diameter corresponding to the inner diameter of the helix and extending from the bottom edge of the helix at least to its top edge, whereby the first cylindrical part is surrounded by the helix, said support ring (8) being substantially cylindrical with a larger diameter and smaller height than said first cylindrical part, and the connector part (9) comprises a second cylindrical part with a smaller diameter than said first cylindrical part and surrounding the leg part (3) of the helix.

12. An antenna according to claim 10 or 11, wherein said first cylindrical part, support ring, and second cylindrical part comprise a closed cylindrical body.

13. An antenna according to claim 10 or 11, wherein said first cylindrical part, support ring, and second cylindrical part comprise a cylindrical body which is at least partly hollow.

14. An antenna according to claim 1, wherein the electrically conducting means comprises a coating formed at the lower end of the connector part (4).

15. A method to manufacture an antenna, wherein a one piece connector (9) and support part (7) is connected to a helix (2) and the helix (2) is covered with a protective material, said method comprising the steps of:

forming one-piece support and connector part (4) comprising an upper support part and a lower connector part, whereby the support part (7) supports the helix, and the connector part (9) surrounds a helix leg part (3), which is bent towards the axis of the helix and extends in the direction of the axis through the connector part (9), forming a widened section at the lower end of the support part to thereby form a support ring (8) which supports a threaded part of the helix (2), connecting an electrically conducting means (5) to the connector part in order to provide an electrical contact for the antenna, and providing the final appearance of the antenna by forming an elastic protective material layer (6) around the helix and the support part supporting the helix.

16. A method according to claim 15, wherein the material used in the molding comprises hard, heat-resistant plastic, polymer material, ceramic material, or any corresponding material that can be coated.

17. A method according to claim 15 or 16, further including the step of providing connecting means in the connector part (9) below the protecting layer (6) in order to connect the antenna.

18. A method according to claim 17, wherein the step of providing connecting means comprises forming threads on said connector part.

19. A method according to claims 15 or 16, further including the steps of:

connecting a sleeve (5) to the connector part (9) in order to provide the electrical contact to the antenna, and arranging one of (i) the sleeve in the injection mold for the antenna so that it will be fastened to the connector part during the injection molding, and (ii) fastening the sleeve to the connector part.

20. A method according to claim 19, wherein connecting means are formed in the sleeve (5) in order to connect the antenna, and the sleeve is fastened to the connector (9) before a protective layer (6) is formed to extend over the top end of the sleeve.

21. A method according to claim 20, wherein the step of forming connecting means comprises forming threads on said sleeve.

22. A method according to claim 19, wherein:

the step of forming said integral support and connector part comprises injection molding; and the step of fastening comprises at least one of pressing or gluing the sleeve to the connector part after the injection molding.

23. A method according to claims 15 or 16, wherein the support part (7) is formed within the helix as a cylindrical body having a diameter corresponding to the inner diameter of the helix and extending from the bottom edge of the threaded part of the helix at least to its top edge, and the support ring (8) is cylindrical and has a larger diameter and smaller height than said support part and is formed between said support part and said connector part.

24. A method according to claims 15 or 16, wherein the support part (7) is formed to surround the helix as a cylindrical body having a diameter corresponding to the outer diameter of the helix and extending from the bottom edge of the threaded part of the helix at least to its top edge, and the support ring (8) is cylindrical and has a larger diameter and smaller height than said support part and is formed between said support part and said connector part.

25. A method according to claim 15, wherein the step of forming said integral support and connector part comprises injection molding.

* * * * *

UNITED STATES PATENT AND TRADEMARK OFFICE

CERTIFICATE OF CORRECTION

PATENT NO. : 5,905,475
DATED : May 18, 1999
INVENTOR(S) : Petteri Annamaa

It is certified that error appears in the above-identified patent and that said Letters Patent is hereby corrected as shown below:

Title page,
Item [22] Filing Date, change "Apr. 5. 1995" to -- Apr. 5, 1996 --.

Signed and Sealed this

Fifth Day of March, 2002

*Attest:*

*Attesting Officer*

JAMES E. ROGAN
*Director of the United States Patent and Trademark Office*